US011229936B2

(12) United States Patent
Izumikawa et al.

(10) Patent No.: US 11,229,936 B2
(45) Date of Patent: Jan. 25, 2022

(54) PRESS DEVICE, AND METHOD OF MANUFACTURING ELLIPTICAL-CYLINDRICAL MEMBER

(71) Applicant: FUTABA INDUSTRIAL CO., LTD., Okazaki (JP)

(72) Inventors: Daisuke Izumikawa, Okazaki (JP); Hiromiki Koyama, Tsushima (JP)

(73) Assignee: FUTABA INDUSTRIAL CO., LTD, Okazaki (JP)

( * ) Notice: Subject to any disclaimer, the term of this patent is extended or adjusted under 35 U.S.C. 154(b) by 0 days.

(21) Appl. No.: 16/594,796

(22) Filed: Oct. 7, 2019

(65) Prior Publication Data

US 2020/0122210 A1 Apr. 23, 2020

(30) Foreign Application Priority Data

Oct. 19, 2018 (JP) ..... JP2018-197733

(51) Int. Cl.
*B21D 5/01* (2006.01)
*B21C 37/15* (2006.01)
*B21C 37/08* (2006.01)

(52) U.S. Cl.
CPC ..... *B21D 5/015* (2013.01); *B21C 37/0803* (2013.01); *B21C 37/155* (2013.01)

(58) Field of Classification Search
CPC ..... B21D 5/01; B21D 5/015; B21D 22/00; B21D 22/02; B21D 22/025; B21D 51/00; B21C 37/08; B21C 37/083; B21C 37/0815; B21C 37/15; B21C 37/155; B21C 37/0803; B30B 15/02; B30B 15/022; Y10S 100/918; B29C 66/4322
USPC ..... 100/918; 72/367.1, 368, 370.04, 370.24, 72/381, 383, 394, 51
See application file for complete search history.

(56) References Cited

U.S. PATENT DOCUMENTS 1,850,679 A * 3/1932 Leis ..... B21D 5/01 72/337

FOREIGN PATENT DOCUMENTS

GB 340776 A * 1/1932 ..... B21C 37/0815
JP 6-312226 A * 11/1994 ..... B21C 37/155
JP 2000079415 A * 3/2000
JP 2004025224 A * 1/2004
(Continued)

OTHER PUBLICATIONS

JP 2000079415 A, Machine Translation, 2000 (Year: 2000).*
(Continued)

*Primary Examiner* — Edward T Tolan
(74) *Attorney, Agent, or Firm* — Withrow & Terranova, P.L.L.C.; Vincent K. Gustafson

(57) ABSTRACT

A press device includes: a first die having a shape of an elliptical cylinder; a second die having a first recess that forms a part of an elliptical-cylindrical space configured to arrange the first die therein; a third die having a second recess to be combined with the first recess to form the elliptical-cylindrical space; a first press mechanism that inserts the first die along a radial direction of the first die to the first recess of the second die over which the flat metal stock is placed so as to press the metal stock; and a second press mechanism that moves the third die relative to the first die inserted to the first recess so as to confine the first die and the metal stock in the elliptical-cylindrical space formed by the first recess and the second recess.

3 Claims, 5 Drawing Sheets

(56) References Cited

FOREIGN PATENT DOCUMENTS

| | | | | |
|---|---|---|---|---|
| JP | 2011161446 | A | 8/2011 | |
| WO | 96/27076 | A1 * | 9/1996 | ..... B21C 37/0815 |

OTHER PUBLICATIONS

JP 2004025224 A, Machine Translation, 2004 (Year: 2004).*
JP 2000079415 Machine Translation, 2000 (Year: 2000).*
JP 2004025224 Machine Translation, 2004 (Year: 2004).*
Notice of Reasons for Refusal for Japanese Patent Application No. 2018-197733, dated Oct. 20, 2020, 7 pages.
Notice of the First Patent Examination Opinion for Chinese Patent Application No. 201910953226.6, dated Dec. 28, 2020, 12 pages.

* cited by examiner

PRESS DEVICE, AND METHOD OF MANUFACTURING ELLIPTICAL-CYLINDRICAL MEMBER

CROSS-REFERENCE TO RELATED APPLICATIONS

This application claims the benefit of Japanese Patent Application No. 2018-197733 filed on Oct. 19, 2018 with the Japan Patent Office, the entire disclosure of which is incorporated herein by reference.

BACKGROUND.

The present disclosure relates to a press device, and a method of manufacturing an elliptical-cylindrical member.

A known method for manufacturing a metal member in the form of an elliptical cylinder is pressing a true cylindrical body having a core metal inside with an upper die and a lower die (see Japanese Unexamined Patent Application Publication No. 2011-161446).

SUMMARY

In the above method, since the core metal does not contact the inside of an apex portion (that is, portion having a minimum curvature radius) of the cylindrical body that intersects a major axis of an ellipse, press-forming of this portion becomes insufficient. Therefore, shape accuracy of the obtained member decreases.

In one aspect of the present disclosure, it is preferable to provide a press device that can form an elliptical-cylindrical member with high shape accuracy.

One aspect of the present disclosure provides a press device that presses a flat metal stock into an elliptical cylinder. The press device comprises a first die, a second die, a third die, a first press mechanism and a second press mechanism. The first die has a shape of an elliptical cylinder. The second die has a first recess that forms a part of an elliptical-cylindrical space configured to arrange the first die therein. The third die has a second recess to be combined with the first recess to form the elliptical-cylindrical space. The first press mechanism inserts the first die along a radial direction of the first die to the first recess of the second die over which the flat metal stock is placed so as to press the metal stock. The second press mechanism moves the third die relative to the first die inserted to the first recess so as to confine the first die and the metal stock in the elliptical-cylindrical space formed by the first recess and the second recess, thereby pressing an unpressed portion of the metal stock that is not inserted to the first recess.

According to the configuration as such, the metal stock can be pressed into an elliptical cylinder with the second die and the third die while the first die is brought into contact with the metal stock from inside of an apex portion that intersects a major axis of the elliptical cylinder. Therefore, decrease in shape accuracy of the apex portion of the elliptical-cylindrical member can be reduced. As a result, shape accuracy of the elliptical-cylindrical member can be improved.

In one aspect of the present disclosure, the second press mechanism may have ends of the metal stock butted against each other at an apex intersecting a major axis of an ellipse, when viewed from a central axis direction of the first die. According to the configuration as such, decrease in shape accuracy of the apex portion intersecting the major axis can be reliably reduced.

In one aspect of the present disclosure, a portion on an outer circumferential surface of the first die facing the first recess may have a smaller curvature radius than a portion of the first recess facing that portion of the first die. According to the configuration as such, a force can be exerted in a direction in which the metal stock is closed at a portion arranged in the first recess together with the first die by the first press mechanism while shape accuracy of the apex portion of the elliptical-cylindrical member is maintained. Therefore, it is possible to suppress springback of a portion of the metal stock arranged in the second recess together with the first die by the first press mechanism. As a result, shape accuracy of the elliptical-cylindrical member can be further improved.

In one aspect of the present disclosure, the press device may further comprise a guide mechanism to guide the unpressed portion of the metal stock toward the first die in a state in which the first die is inserted to the first recess. According to the configuration as such, when the second press mechanism operates, the unpressed portion of the metal stock can be easily and reliably guided into the second recess. As a result, productivity of the elliptical-cylindrical member can be increased.

Another aspect of the present disclosure provides a method of manufacturing an elliptical-cylindrical member using a flat metal stock. The method comprises: preparing a first die having a shape of elliptical cylinder, a second die having a first recess that forms a part of an elliptical-cylindrical space configured to arrange the first die therein, a third die having a second recess to be combined with the first recess to form the elliptical-cylindrical space; placing the flat metal stock over the first recess; inserting the first die along a radial direction of the first die to the first recess of the second die over which the metal stock is placed so as to press the metal stock; and moving the third die relative to the first die inserted to the first recess so as to confine the first die and the metal stock in the elliptical-cylindrical space formed by the first recess and the second recess, thereby pressing an unpressed portion of the metal stock that is not inserted to the first recess.

According to the configuration as such, the metal stock can be pressed into an elliptical cylinder by the second die and the third die while the first die is brought into contact with the metal stock from inside at an apex portion intersecting a major axis of the elliptical cylinder. Therefore, decrease in shape accuracy of the elliptical-cylindrical member at the apex portion can be reduced.

BRIEF DESCRIPTION OF THE DRAWINGS

An example embodiment of the present disclosure will be described hereinafter with reference to the accompanying drawings, in which.

DETAILED DESCRIPTION OF EXEMPLARY EMBODIMENTS

1. First Embodiment

[1-1. Configuration]

Figure 1:
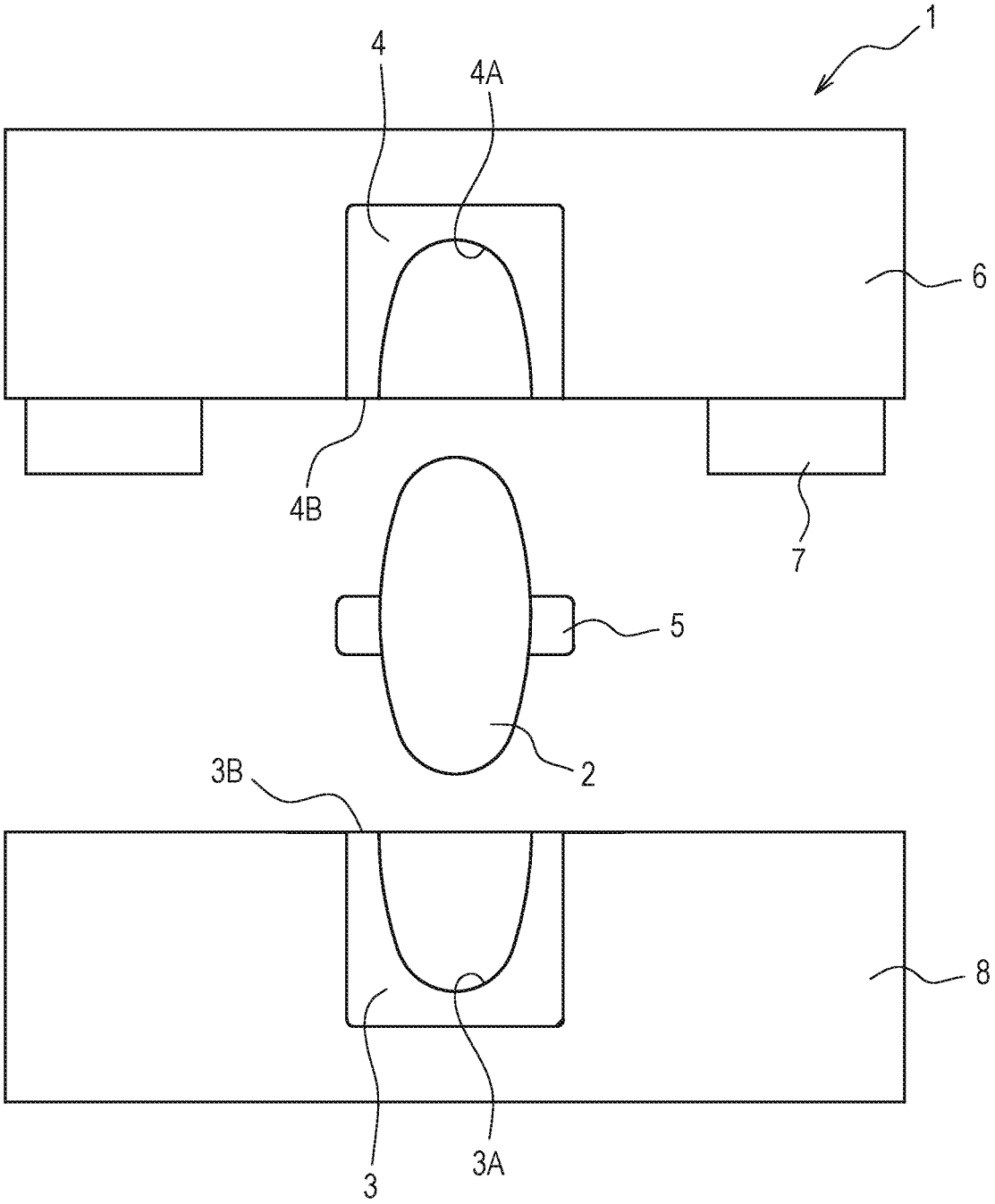
FIG. 1 is a schematic front view of a press device of an embodiment.

A press device 1 shown in FIG. 1 presses a flat metal stock (that is, workpiece) into an elliptical cylinder.

Figure 2:
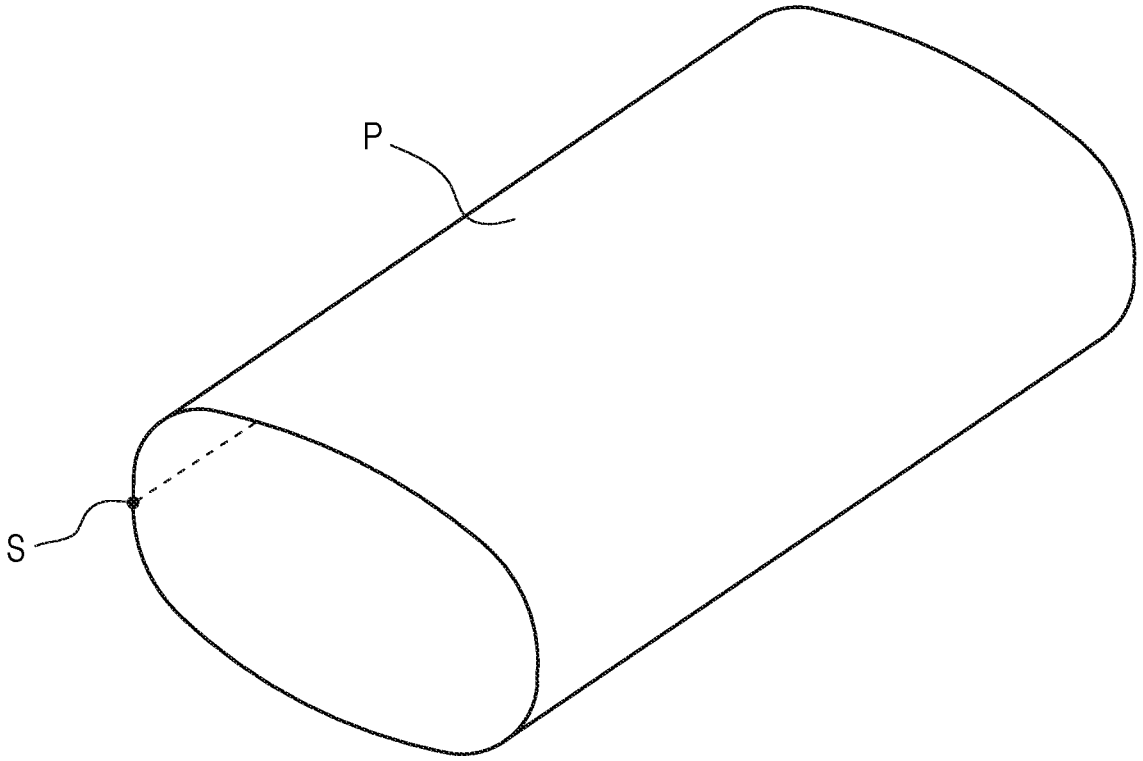
FIG. 2 is a schematic perspective view of an elliptical-cylindrical member obtained from a metal stock pressed by the press device of FIG. 1.

An elliptical-cylindrical member P shown in FIG. 2 is obtained by welding the metal stock pressed into an elliptical cylinder using the press device 1. The elliptical-cylindrical member P is used in exhaust parts such as a muffler of an automobile and the like.

The press device 1 comprises a first die 2, a second die 3, a third die 4, a first press mechanism 5, a second press mechanism 6, a guide mechanism 7, and a pedestal 8.

<First Die>

The first die 2 is made of metal and has a shape of an elliptical column. The first die 2 is configured to be arranged in an elliptical-cylindrical space formed by the second die 3 and the third die 4 to be described later.

The first die 2 is supported by the first press mechanism 5 to be described later. In the present embodiment, the first die 2 is supported in a direction in which a central axis direction (that is, longitudinal direction) of the elliptical column is parallel to a horizontal direction and in which a major axis of an ellipse is parallel to a vertical direction.

<Second Die>

The second die 3 is made of metal and has a first recess 3A that forms a part of the elliptical-cylindrical space configured to arrange the first die 2 therein, and a mount surface 3B configured to mount the metal stock.

The second die 3 is supported by the pedestal 8. In the present embodiment, the second die 3 is arranged below the first die 2. The first recess 3A extends in the form of a groove along a longitudinal direction of the first die 2 (that is, direction perpendicular to a sheet surface of FIG. 1 drawing). Also, the first recess 3A is formed in a direction in which the deepest point is the lowest point, that is, a direction in which a major axis of the elliptical-cylindrical space is parallel to the vertical direction.

The mount surface 3B is a plane where the metal stock to be pressed is placed. In the present embodiment, the mount surface 3B is parallel to the horizontal direction (that is, horizontal plane). Also, the mount surface 3B is brought into contact with the third die 4 upon pressing.

In the present embodiment, the second die 3 is stationary and is fixed in place. Therefore, when the first die 2 and the third die 4 are moved relative to the second die 3, the metal stock is pressed into an elliptical cylinder.

<Third Die>

The third die 4 is made of metal and has a second recess 4A to be combined with the first recess 3A to form the elliptical-cylindrical space, and a bottom surface 4B which is brought into contact with the second die 3.

The third die 4 is supported by the second press mechanism 6 to be described later. In the present embodiment, the third die 4 is arranged above the first die 2. The second recess 4A extends in the form of a groove along the longitudinal direction of the first die 2. Also, the second recess 4A is formed in a direction in which the deepest point is the highest point, that is, a direction in which the major axis of the elliptical-cylindrical space is parallel to the vertical direction.

Figure 3:
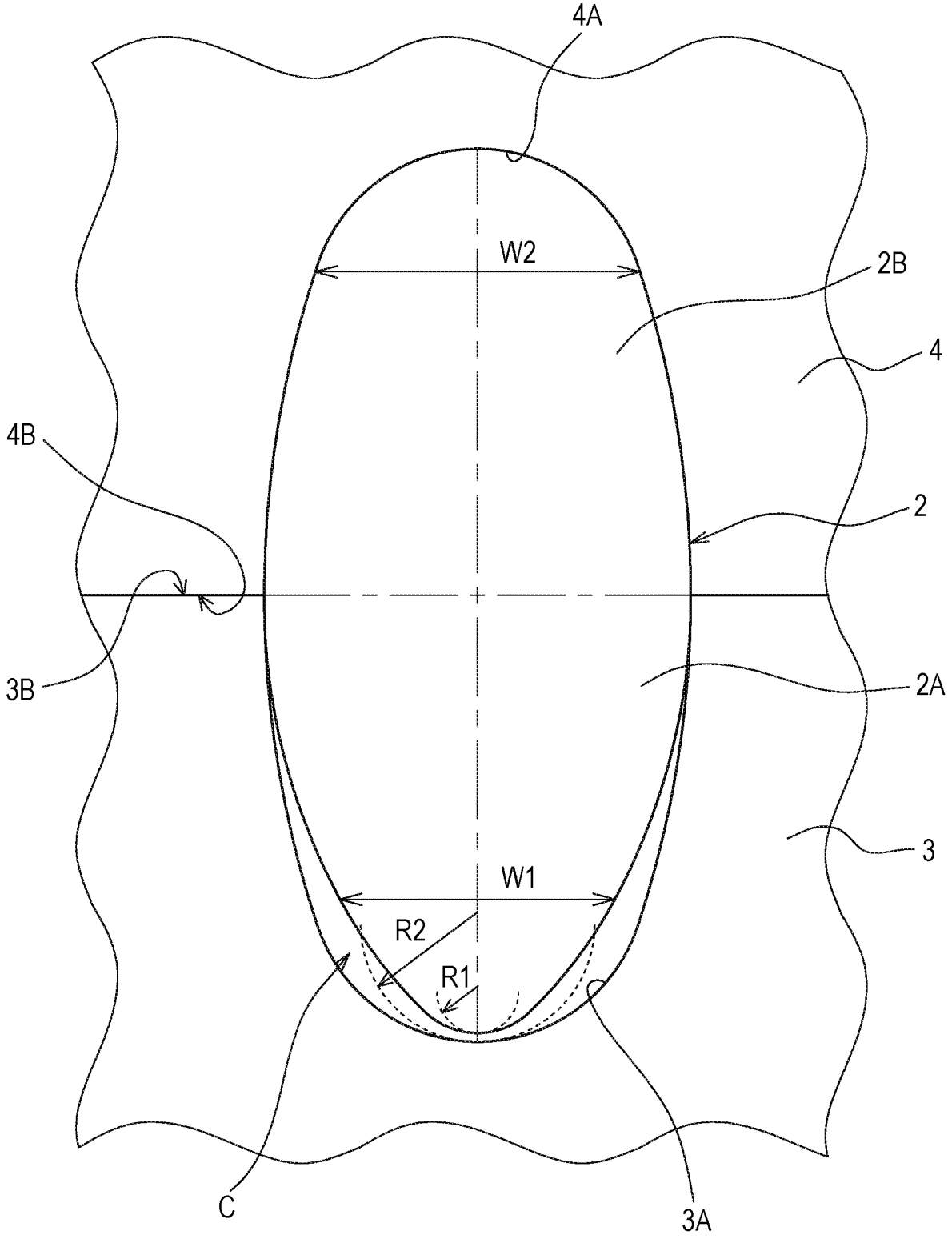
FIG. 3 is a schematic front view of a first die, a first recess and a second recess of the press device of FIG. 1.

As shown in FIG. 3, the first recess 3A and the second recess 4A each have a shape obtained by dividing the elliptical-cylindrical space into two in a plane parallel to a minor axis of the ellipse in the vicinity of the minor axis. Also, abutting surfaces of the second die 3 and the third die 4 (that is, the mount surface 3B and the bottom surface 4B) are parallel to a minor axis of the elliptical-cylindrical space.

<First Press Mechanism>

The first press mechanism 5 inserts a first portion 2A of the first die 2 along a radial direction of the first die 2 to the first recess 3A of the second die 3 over which the flat metal stock is placed on the mount surface 3B so as to press the metal stock.

In the present embodiment, the first press mechanism 5 inserts the first die 2 to the first recess 3A along a direction parallel to the major axis of the elliptical-cylindrical space (specifically, downward). This movement of the first die 2 curves the metal stock along an outer circumferential surface of the first die 2 and an inner surface of the first recess 3A, and forms a lower half of the elliptical cylinder.

<Second Press Mechanism>

The second press mechanism 6 moves the third die 4 relative to the first die 2 that is inserted to the first recess 3A by the first press mechanism 5 to confine the first die 2 and the metal stock in the elliptical-cylindrical space formed by the first recess 3A and the second recess 4A.

In other words, the second press mechanism 6 inserts a second portion 2B of the first die 2 that is not inserted to the first recess 3A to the second recess 4A of the third die 4 together with the metal stock along the radial direction of the first die 2. As a result, the second press mechanism 6 presses the unpressed portion of the metal stock that is not inserted to the first recess 3A.

In the present embodiment, the second press mechanism 6 moves the third die 4 along the direction parallel to the major axis of the elliptical-cylindrical space (specifically, downward) so as to superpose the third die 4 on the first die 2 and the second die 3. As a result, the first recess 3A and the second recess 4A are combined to form the elliptical-cylindrical space.

The unpressed portion of the metal stock which is not pressed by the first press mechanism 5 is curved along the outer circumferential surface of the first die 2 and the inner surface of the second recess 4A in the elliptical-cylindrical space. As a result, the whole metal stock is processed into an elliptical cylinder.

Also in the present embodiment, the second press mechanism 6 has the ends of the metal stock butted against each other at an apex S (see FIG. 2) that intersects the major axis of the ellipse by relative movement of the third die 4, when viewed from a central axis direction of the first die 2 (that is, direction perpendicular to a sheet surface of FIG. 1 drawing). The elliptical-cylindrical member P is obtained by welding the abutting ends.

A curvature radius R1 of a portion (apex portion, for example) on the outer circumferential surface of the first die 2 facing the first recess 3A is smaller than a curvature radius R2 of a portion of the first recess 3A facing that portion of the first die 2. Also, a clearance C is provided between the outer circumferential surface of the first die 2 and the inner surface of the first recess 3A.

In other words, in the first die 2, the curvature radius R1 of the outer circumferential surface of the first portion 2A inserted to the first recess 3A is smaller than the curvature radius R2 of the outer circumferential surface of the second portion 2B inserted to the second recess 4A. That is, in comparison of width in the same distance from the minor axis (that is, length in a direction parallel to the minor axis), a width W1 of the first portion 2A is smaller than a width W2 of the second portion 2B.

A sectional shape vertical to a central axis of the first die 2 is a line symmetrical shape having the major axis of the ellipse as an axis of symmetry. Also, the sectional shape of the first die 2 is constant along the central axis direction and does not change.

<Guide Mechanism>

The guide mechanism 7 guides the unpressed portion of the metal stock toward the first die 2 when the first die 2 is inserted to the first recess 3A.

Specifically, the guide mechanism 7 has a portion slidable in a direction parallel to a minor axis of the first die 2 (that is, horizontal direction). Also, the guide mechanism 7 is attached to the second press mechanism 6 and moves in an up-down direction with the third die 4.

The guide mechanism 7, for example, slides toward the first die 2 so as to push the metal stock against the first die 2, and guides the metal stock to the second recess 4A when the second press mechanism 6 operates. The guide mechanism 7 separates from the first die 2 after leading ends of the metal stock enter the second recess 4A.

[1-2. Effect]

According to the above-detailed embodiment, the following effect can be obtained.

(1a) The metal stock can be pressed into an elliptical cylinder by the second die 3 and the third die 4 while the first die 2 is brought into contact with the metal stock in the apex portion that intersects the major axis of the elliptical cylinder. Therefore, decrease in shape accuracy in the apex portion of the elliptical-cylindrical member can be reduced. As a result, shape accuracy of the elliptical-cylindrical member can be improved.

(1b) Decrease in shape accuracy in the apex portion can be reliably reduced by having the ends of the metal stock butted against each other in the apex S that intersects the major axis of the ellipse by the second press mechanism 6.

(1c) The curvature radius R1 of the portion on the outer circumferential surface of the first die 2 facing the first recess 3A is smaller than the curvature radius R2 of the portion of the first recess 3A facing that portion of the first die 2. Therefore, while shape accuracy of the apex portion of the elliptical-cylindrical member is maintained, a force can be exerted in the direction in which the metal stock is closed at the portion arranged in the first recess 3A together with the first die 2 by the first press mechanism 5. Thus, it is possible to suppress springback of the portion of the metal stock arranged in the second recess 4A together with the first die 2 by the first press mechanism 5. As a result, shape accuracy of the elliptical-cylindrical member can be further improved.

(1d) The curvature radius R1 of the portion of the first die 2 facing the first recess 3A is smaller than the curvature radius R2 of the first recess 3A, and the ends of the metal stock are butted against each other at the apex S by the second press mechanism 6. In this way, as compared to butting at an apex that intersects the minor axis of the ellipse, pressing by the second press mechanism 6 can be started from a portion having a larger curvature radius of the unpressed portion of the metal stock. Therefore, springback after the unpressed portion is pressed can be suppressed, and decrease in shape accuracy of the apex portion can be reliably reduced. As a result, shape accuracy of the elliptical-cylindrical member can be improved.

(1e) The unpressed portion of the metal stock can be easily and reliably guided to the second recess 4A by the guide mechanism 7 when the second press mechanism 6 operates. As a result, productivity of the elliptical-cylindrical member can be improved.

2. Second Embodiment

[2-1. Configuration]

Figure 4:
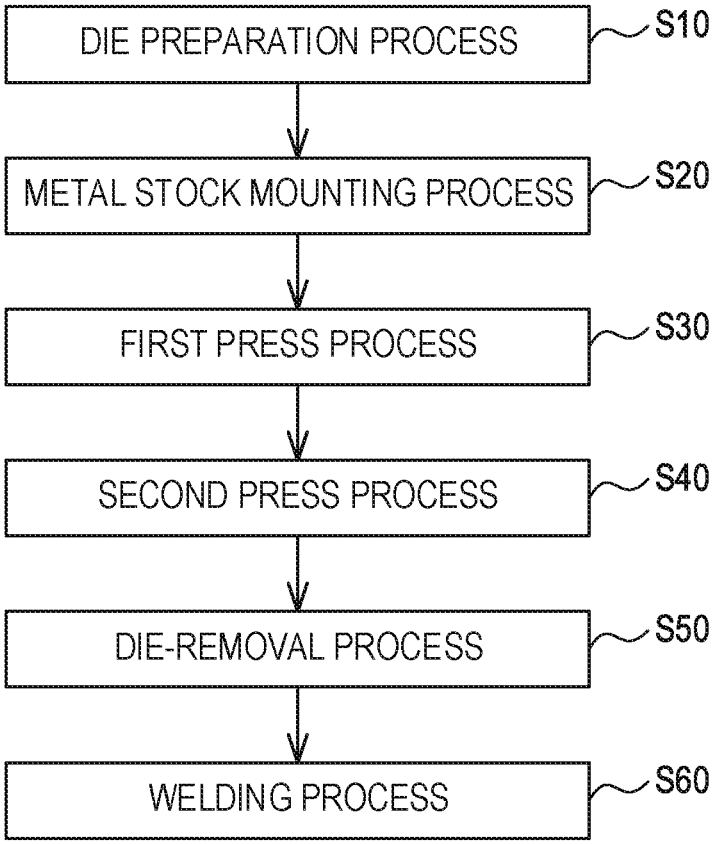
FIG. 4 is a flow diagram of a method of manufacturing an elliptical-cylindrical member in the embodiment.

A method of manufacturing an elliptical-cylindrical member shown in FIG. 4 uses a flat metal stock to obtain the elliptical-cylindrical member P shown in FIG. 2.

The method of manufacturing an elliptical-cylindrical member comprises a die preparation process S10, a metal stock mounting process S20, a first press process S30, a second press process S40, a die-removal process S50, and a welding process S60.

<Die Preparation Process>

In this process, the first die 2, the second die 3, and the third die 4 are prepared. That is, the press device 1 shown in FIG. 1 becomes operable so that pressing can be performed.

<Metal Stock Mounting Process>

In this process, the metal stock is mounted on the mount surface 3B of the second die 3 so that the flat metal stock is placed over the first recess 3A.

<First Press Process>

Figure 5A:
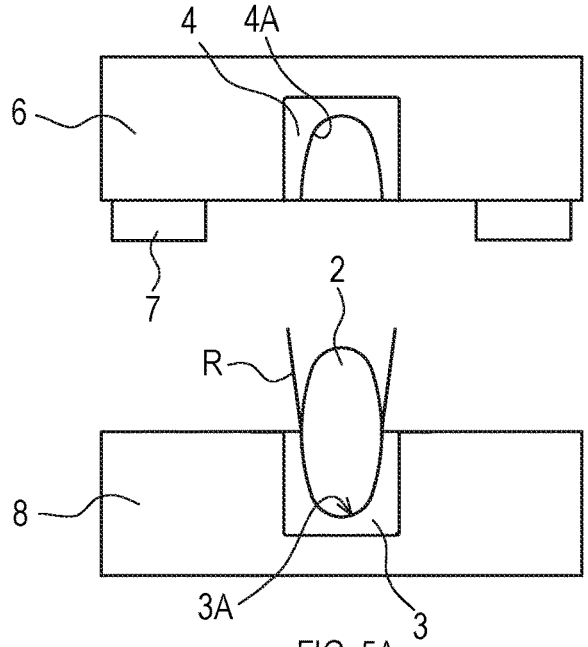
FIG. 5A is a schematic diagram explaining a step of pressing the metal stock by the press device of FIG. 1.

In this process, as shown in FIG. 5A, the first die 2 is inserted along the radial direction of the first die 2 to the first recess 3A of the second die 3 over which the metal stock R is placed so as to partially press the metal stock R. This process curves the metal stock R so that the two ends of the metal stock R face upward.

<Second Press Process>

Figure 5B:
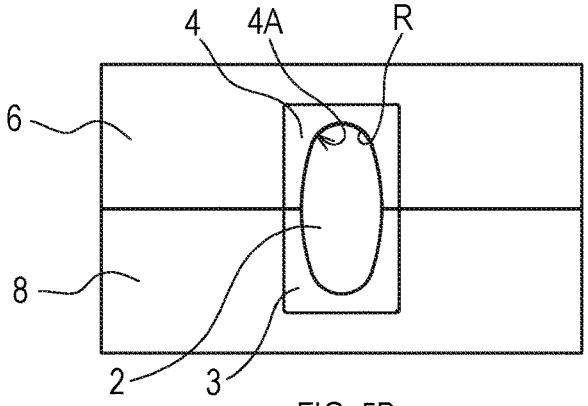
FIG. 5B is a schematic diagram explaining the next step of the step in FIG. 5A.

In this process, as shown in FIG. 5B, the third die 4 is moved relative to the first die 2 inserted to the first recess 3A so that the first die 2 and the metal stock R are confined in the elliptical-cylindrical space formed by the first recess 3A and the second recess 4A. As a result, the unpressed portion of the metal stock R that is not inserted to the first recess 3A is pressed.

At this time, the unpressed portion of the metal stock R is guided toward the first die 2 by the guide mechanism 7. Thereafter, the third die 4 is moved to a position to be brought into contact with the second die 3. As a result, the elliptical-cylindrical space is formed, and the metal stock R is curved so as to cover an outer circumferential surface of the first die 2 in the elliptical-cylindrical space. Pressing of the metal stock R is complete.

<Die-Removal Process>

Figure 5C:
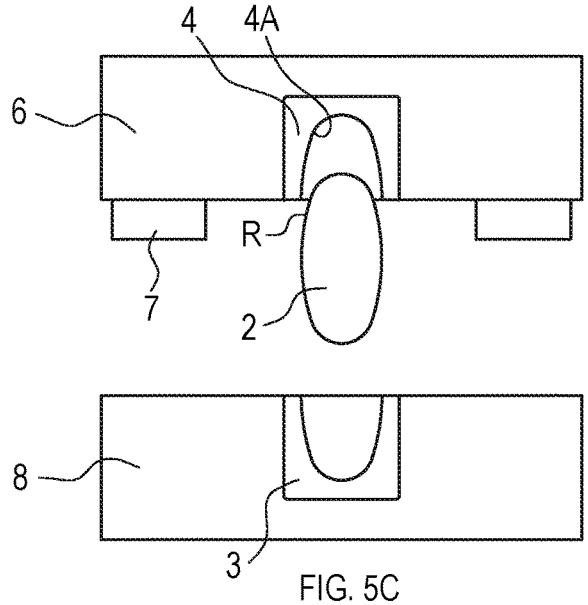
FIG. 5C is a schematic diagram explaining the next step of the step in FIG. 5B.

In this process, as shown in FIG. 5C, each die is removed from the pressed metal stock R, and the metal stock R processed into an elliptical cylinder is removed from the press device 1.

Specifically, the second die 3, the third die 4, and the first die 2 are removed in this order. In the present embodiment, firstly, the third die 4 and the first die 2 are moved upward at the same time so as to remove the second die 3. Thereafter, only the third die 4 is moved upward to remove the third die 4. Lastly, the elliptical-cylindrical metal stock R is slid in the central axis direction of the first die 2 to remove the first die 2.

When the second die 3 and/or the third die 4 is removed, the metal stock R may be pushed on the first die 2 by the guide mechanism 7. In this way, springback and dropping from the first die 2 of the metal stock R can be inhibited.

<Welding Process>

In this process, the abutting ends of the metal stock R are welded along a central axis direction of the elliptical cylinder so as to process the metal stock R into a ring. As a result, the elliptical-cylindrical member P is obtained.

[2-2. Effect]

According to the above-detailed embodiment, the following effect can be obtained.

(2a) While the first die 2 is brought into contact with the metal stock from inside at the apex portion intersecting the major axis of the elliptical cylinder, the metal stock is pressed into an elliptical cylinder by the second die 3 and the third die 4. Therefore, decrease in shape accuracy of the apex portion of the elliptical-cylindrical member can be reduced.

3. Other Embodiments

The embodiments of the present disclosure have been described above. However, the present disclosure is not limited to the above-described embodiments and can be modified variously.

(3a) In the press device 1 of the above-described embodiments, it is not always necessary to have the ends of the metal stock butted against each other at the apex intersecting the major axis of the ellipse. In other words, the ends may be butted against each other at an apex intersecting the minor axis, or may be butted at a portion other than the apex.

(3b) In the press device 1 of the above-described embodiments, the curvature radius R1 of the portion facing the first recess 3A may not be necessarily smaller than the curvature radius R2 of the portion of the first recess 3A facing that portion.

(3c) The press device 1 of the above-described embodiments may not necessarily comprise the guide mechanism 7. Also, in the method of manufacturing the elliptical-cylindrical member in the above-described embodiment, the unpressed portion of the metal stock R may not be necessarily pushed on the first die 2 in the second press process.

For example, an end on an opening side of the second recess 4A of the third die 4 may be partially widened (that is, guide notch may be provided) to guide the metal stock R to the second recess 4A. In this case, a convex portion that fills the notch may be provided in the second die 3.

(3d) In the press device 1 of the above-described embodiments, the first recess 3A and the second recess 4A may each have a shape obtained by dividing the elliptical-cylindrical space into two by a plane parallel to the major axis. In other words, the first die 2 may be inserted along a direction parallel to the minor axis of the first die 2 to the first recess 3A.

Also, the first press mechanism 5 may have the first die 2 fixed and move the second die 3, or may move both the first die 2 and the second die 3. Similarly, the second press mechanism 6 may have the third die 4 fixed and move the first die 2 and the second die 3, or may move all the dies.

Further, a moving direction (that is, press direction) of the first die 2, the second die 3, and the third die 4 is not limited to the up-down direction. In other words, the moving direction of these dies may be a horizontal direction, or a direction other than the up-down direction and the horizontal direction.

(3e) A function achieved by one element in the above-described embodiments may be divided into two or more elements. A function achieved by two or more elements may be integrated into one element. Further, a part of the configuration of any of the above-described embodiments may be omitted. At least a part of the configuration of any of the above-described embodiments may be added to or replaced with the configuration of the other embodiments described above. It should be noted that any and all modes that are encompassed in the technical ideas defined by the languages in the scope of the claims are embodiments of the present disclosure.

What is claimed is:

1. A method of manufacturing an elliptical-cylindrical member using a flat metal stock, the method comprising:

preparing a first die having a shape of elliptical cylinder, a second die having a first recess that forms a part of an elliptical-cylindrical space configured to arrange the first die therein, a third die having a second recess to be combined with the first recess to form the elliptical-cylindrical space;

placing the flat metal stock over the first recess;

inserting the first die along a radial direction of the first die to the first recess of the second die over which the metal stock is placed so as to press the metal stock; and moving the third die relative to the first die inserted to the first recess so as to confine the first die and the metal stock in the elliptical-cylindrical space formed by the first recess and the second recess, thereby pressing an unpressed portion of the metal stock that is not inserted to the first recess, wherein a portion on an outer circumferential surface of the first die, which faces the first recess, has a smaller curvature radius than a portion of the first recess facing the portion on the outer circumferential surface of the first die, wherein an insertion direction of the first die and an insertion direction of the third die are each parallel to a major axis of the elliptical-cylindrical space, the major axis of the elliptical-cylindrical space being longer than a minor axis of the elliptical-cylindrical space, wherein the first die includes a first portion to be inserted into the first recess and a second portion to be inserted into the second recess, and wherein, in comparison in length in a direction parallel to the minor axis at a position distanced from the minor axis by the same distance, a length of the first portion is smaller than a length of the second portion.

2. The method of manufacturing an elliptical-cylindrical member according to claim 1, wherein the pressing the unpressed portion includes bringing ends of the metal stock into abutment against each other at an apex intersecting a major axis of an ellipse of the first die, which is longer than a minor axis of the ellipse of the first die, when viewed from a central axis direction of the first die.

3. The method of manufacturing an elliptical-cylindrical member according to claim 1, further comprising sliding a guide mechanism, with the first die inserted to the first recess, in a direction parallel to the minor axis of the elliptical-cylindrical space, which is shorter than the major axis of the elliptical-cylindrical space, whereby the unpressed portion of the metal stock is pushed against the first die.

* * * * *